United States Patent [19]

Watermann et al.

[11] Patent Number: 4,749,311

[45] Date of Patent: Jun. 7, 1988

[54] FOOT ELEMENT AND COOPERABLE STRUT ELEMENT FOR USE IN A ROOF SUPPORT MECHANISM

[75] Inventors: Willy Watermann, Dortmund; Udo Hofmann, Castrop-Rauxel, both of Fed. Rep. of Germany

[73] Assignee: Klöckner-Becorit GmbH, Castrop-Rauxel, Fed. Rep. of Germany

[21] Appl. No.: 81,151

[22] Filed: Aug. 4, 1987

[30] Foreign Application Priority Data

Aug. 4, 1986 [DE] Fed. Rep. of Germany ... 8620900[U]

[51] Int. Cl.[4] ..... E21D 15/00

[52] U.S. Cl. ..... 405/290; 405/295; 405/291; 403/348; 403/353

[58] Field of Search ..... 405/290–297; 403/348, 353

[56] References Cited

U.S. PATENT DOCUMENTS

| | | | |
|---|---|---|---|
| 3,381,480 | 5/1968 | Andrews | 405/296 X |
| 3,383,868 | 5/1968 | Wilkenloh et al. | 405/291 |
| 3,855,802 | 12/1974 | Alacchi | 405/297 |
| 4,056,941 | 11/1977 | Watermann | 405/296 |
| 4,121,426 | 10/1978 | Heyer | 405/296 |
| 4,140,430 | 2/1979 | Blumenthal et al. | 405/291 |
| 4,309,130 | 1/1982 | Bemmerl | 405/291 X |

FOREIGN PATENT DOCUMENTS

| | | | |
|---|---|---|---|
| 2622207 | 1/1977 | Fed. Rep. of Germany | 405/295 |

*Primary Examiner*—Dennis L. Taylor

*Attorney, Agent, or Firm*—Watson, cole, Grindle & Watson

[57] ABSTRACT

A foot element of an adjustable roof support mechanism includes side walls that have aligned guide grooves in their facing surfaces and a spherical bearing surface in a floor portion therebetween. The guide grooves include inclined entry portions and enlarged terminal portions. A cooperable, extendable strut element includes a tubular body having a spherical lower end and two cams extending away from opposite sides near its lower end. The cams are shaped so as to fit within the guide grooves of the foot element. When attaching the strut element to the foot element the cams thereof are moved along the entry portions of the aligned guide grooves and into the terminal portions thereof. Thereafter, the strut is rotated into a use position. When in its use position, the cams cannot be removed from the terminal portions of the guide grooves, thus preventing unintentional separation of the strut element and the foot element.

8 Claims, 2 Drawing Sheets

FOOT ELEMENT AND COOPERABLE STRUT ELEMENT FOR USE IN A ROOF SUPPORT MECHANISM

BACKGROUND OF THE INVENTION

1. Field Of The Invention

The present invention relates to adjustable roof support mechanisms for supporting the roofs of mines, and more particularly to the foot element(s) and the cooperating strut element(s) which form a part of such adjustable roof support mechanisms.

2. The Prior Art

Adjustable roof support mechanisms for supporting the roofs of mines are well known. See, for example, U.S. Pat. Nos. 4,056,941, 4,222,686 and 4,586,851, which disclose such mechanisms, particularly for use in coal mines. Such roof support mechanisms normally include a front shield for contacting and supporting the roof of the mine, a rear shield which is pivotally connected to the front shield, one or more foot elements which rest on the floor of the mine, a plurality of connecting arms which connect the rear end of the foot element(s) to the rear end of the rear shield, and one or more extendable strut elements which extend upwardly from the foot element(s) to the front shield (or else to a rocker arm connected between the front shield and the rear shield). The foot elements and the cooperating strut elements are often constructed such that, after the foot elements are located at the use site, the lower ends of the strut elements can be positioned therein. Side (lateral) liners are then downwardly inserted into the foot elements to prevent unintentional removal of the strut elements from the foot elements. However, inserting such side liners is a rather tedious operation.

It is an object of the present invention to provide a foot element and a cooperating strut element for use in a roof support mechanism, wherein the strut element is easily attachable to the foot element and wherein when the strut element is connected to the foot element for use, undesired separation thereof will be prevented, without the use of side liners.

SUMMARY OF THE INVENTION

According to the present invention the foot element is elongated and includes side walls which have aligned guide grooves in their facing surfaces, the guide grooves including elongated entry portions which are inclined somewhat downwardly as they extend toward the rear end of the foot element and enlarged terminal portions, while the cooperable strut element includes a tubular body having two cams extending away from opposite sides thereof near its lower end, the cams being suitably constructed such that they will move along the elongated entry portions of the respective guide grooves when the strut element is mounted on or removed from the foot element, and when located in the terminal portions of the respective guide grooves, will be rotatable therein to allow the strut element to be oriented in a operational position yet will effectively prevent the strut element from becoming unintentionally separated from the foot element.

In addition to the foregoing, the foot element also includes a floor portion between the side walls, the floor portion including a spherical bearing surface and a vertical slot extending downwardly within the spherical bearing surface, and the tubular body of the extendable strut has a spherical lower end that cooperates with the spherical bearing surface when the cams are located in the respective terminal portions of the guide grooves, as well as a lug which extends outwardly from the lower end and is positioned in the slot in the floor portion to prevent rotation of the tubular body (and thus the strut element as a whole) around its axis when the strut element is oriented in a use position.

A better understanding of the invention will be had by reference to the attached drawings, taken in conjunction with the following discussion.

DETAILED DESCRIPTION OF THE PRERRRED EMBODIMENT

Figure 2:
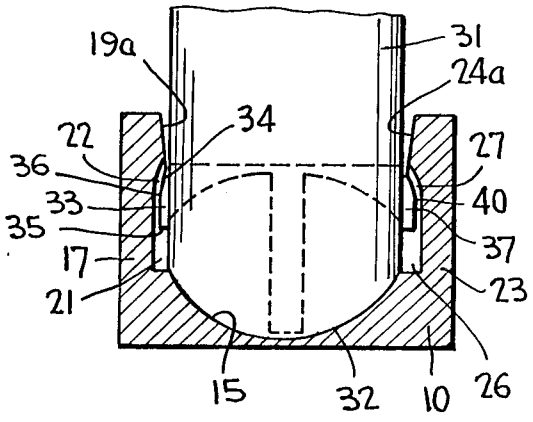
FIG. 2 shows a section along line II—II in FIG. 1.
Figure 1:
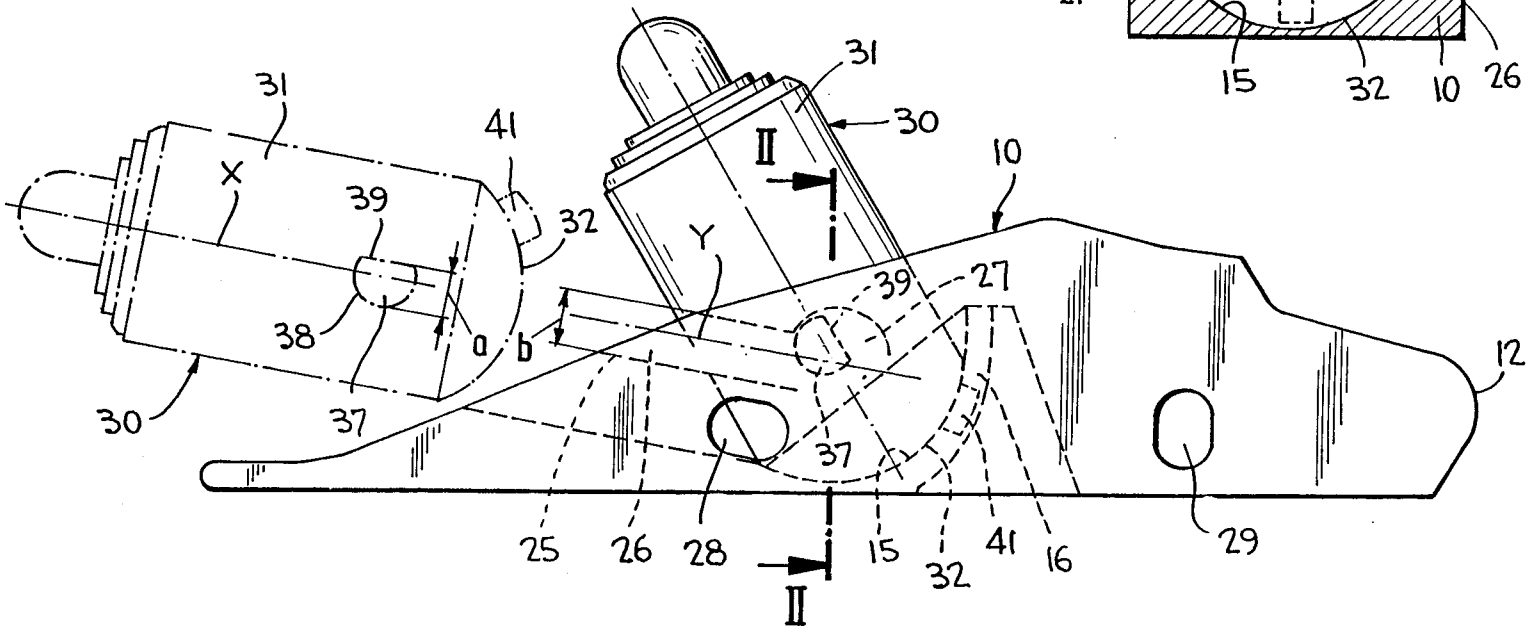
FIG. 1 shows a side view of a foot element and a cooperable strut element constructed according to a preferred embodiment of the invention.
Figure 3:
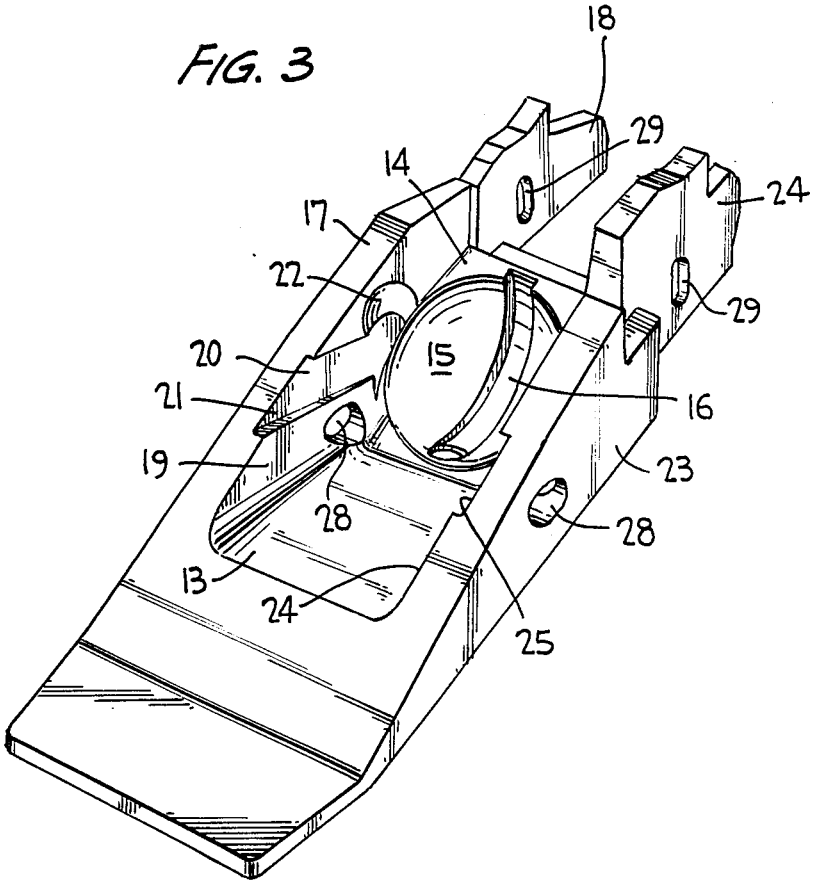
FIG. 3 shows a perspective view of the foot element shown in FIG. 1.

A foot element 10 and cooperable strut element 30 which are constructed according to a preferred embodiment of the present invention is shown in FIGS. 1–3.

The foot element 10 is elongated in shape and extends from a front end 11 to a rear end 12. It is hollowed out along a portion of its length to provide a first floor portion 13, a second floor portion 14 and opposite side walls 17 and 23, which extend above the first and second floor portions 13 and 14. The foot element 10 also includes spaced apart rear flanges 18 and 24 which extend rearwardly of the second floor portion 14.

The first floor portion 13 slopes downwardly as it extends rearwardly of the foot element and the second floor portion slopes upwardly as it extends rearwardly of the first floor portion 13. A spherical bearing surface 15 is formed in the second floor portion so as to be centered between the side walls 17 and 22. In addition, a slot 16 is formed in the second floor portion and extends vertically downwardly through the spherical bearing surface 15 at a point midway between the side walls 17 and 22. The purpose and function of the spherical bearing surface 15 and the slot 16 will become more apparent below.

The side walls 17 and 23 have facing surfaces 19 and 24 which contain aligned guide grooves 20 and 25. The guide grooves include elongated entry portions 21 and 26, which slope slightly downwardly as they extend towards the rear end of the foot element (they are defined by straight and parallel upper and lower ledges that are separated by a distance b and define axes Y), and enlarged terminal portions 22 and 27, which have a generally spherical configuration. The purpose and function of the guide grooves 20 and 25 will become apparent below.

It should be noted that the side walls 17 and 23 also include aligned oblong openings 28 and the rear flanges 18 and 24 include aligned oblong openings 29, these openings enabling the foot element 10 to be attached to an adjacent foot element (not shown). In addition, the upper portions **19*a* and 24*a* of the facing surfaces 19 and 24 of the side walls 17 and 23** are outwardly sloped, as shown in FIG. 2.

The cooperable strut element 30, which is constructed to be extendable, includes a tubular body 31 that has a spherical lower end 32 (the size of the spherical lower end 32 corresponds with the size of the spherical bearing surface 15) and two cams 33 and 37 which extend outwardly from opposite sides of the tubular body 31. In addition, a lug 41 extends away from the spherical lower end 32 and is centered between the cams 33 and 37. The cams 33 and 37 are formed to have side portions 34 and 38 which are cylindrical and side portions 35 and 39 which are flat. The flat side portions extend in a common plane which is parallel with the axis X of the tubular body 31 (in an alternative embodiment the common plane can simply extend in the longitudinal direction of the tubular body). The width of the cams, measured from their flat side portions, is shown as a in FIG. 1. The cams also have spherical end surfaces 36 and 40. These spherical end surfaces extend in a common imaginary sphere with the spherical lower end 32 of the tubular body 31.

When the strut element 30 is connected to the foot element 10 (or intentionally removed therefrom), the tubular body 31 thereof is oriented so that its axis X is aligned with the axes Y of the elongated entry portions 21 and 26 of the guide grooves 20 and 25 (see broken line version of strut element 30 shown in FIG. 1), the cams 33 and 37 are inserted into the elongated entry portions 21 and 26 (note that the width a is less than the width b), and the tubular body is moved relative to the foot element so that the cams become located within the terminal portions 22 and 27. At this point the spherical lower end 32 of the tubular housing 31 will be in an abutting relationship with the spherical bearing surface 15 and the lug 41 will fit within the slot 16. Then the extendable strut element is rotated around a rotation line that extends through the cams 33 and 37 into an operating position. The shape of the cams 33 and 37 and their coaction with the spherical terminal portions 22 and 27 will then prevent movement of the cams along the elongated entry portions of the guide grooves, thus preventing unintentional separation of the elongated strut element from the foot element. The sloped upper portions 19*a* and 24*a* of the side walls 19 and 24 enable the strut element to be slightly angled relative to the longitudinal dimension of the foot element.

Various modifications to the invention as described above can be made and still fall within the scope of the following claims.

We claim:

1. The combination of an elongated foot element and a cooperable strut element which can form a part of a roof support mechanism for supporting the roof of a mine, the elongated foot element having a front end and a rear end and opposite side walls which extend along a portion of its length, said side walls having facing surfaces that contain aligned guide grooves, said aligned guide grooves including elongated entry portions that are sloped downwardly as they extend toward the rear end of said foot element and enlarged terminal portions; and the extendable strut including a tubular body and two cams which respectively extend away from opposite sides of the tubular body near a lower end thereof, each of said cams including a side portion which is cylindrical and a side portion which is flat, each said flat surface portion extending in the longitudinal direction of said tubular body; said cams fitting within and being movable along the respective elongated entry portions of the guide grooves in the facing sides of the side walls of the foot element when the strut is being mounted on or removed from said foot element, and when located in the terminal portions of the grooves, are rotatable therein to enable said strut element to be oriented in a use position yet prevent unintentional separation from said foot element.

2. The combination as defined in claim 1, wherein said cams have end surfaces which are spherical.

3. The combination as defined in claim 2, wherein the spherical end surfaces of said cams extend in an imaginary sphere defined by the spherical lower end of said tubular body.

4. The combination as defined in claim 2, wherein the enlarged terminal portions of said guide grooves each have a generally spherical configuration.

5. The combination as defined in claim 1, wherein said tubular body defines an axis, and wherein the flat side portions of said cams extend in a common plane which is parallel to said axis.

6. The combination as defined in claim 1, wherein said foot element includes a floor portion which extends between said side walls, said floor portion including a spherical bearing surface which is centered between said side walls, and wherein the lower end of said tubular body has a spherical shape which is sized to conform to the spherical bearing surface.

7. The combination as defined in claim 6, wherein said floor portion includes a vertical slot which extends through said spherical bearing surface at a point midway between said side walls, and wherein said tubular body includes a lug extending away from the lower end thereof, said lug being positionable within said slot when the cams thereon are rotatably positioned in the terminal portions of said guide grooves.

8. In adjustable roof support mechanism for supporting the roof of a mine which includes a front shield, a rear shield, an elongated foot element and a cooperable strut element, the improvement wherein said elongated foot element has a front end and a rear end and opposite side walls which extend along a portion of its length, said side walls having facing surfaces that contain aligned guide grooves, said aligned guide groove including elongated entry portions that are sloped downwardly as they extend toward the rear end of said foot element and enlarged terminal portions; and the extendable strut includes a tubular body and two cams which respectively extend away from opposite sides of the tubular body near a lower end thereof, each of said cams including a side portion which is cylindrical and a side portion which is flat, each said flat surface portion extending in the longitudinal direction of said tubular body; said cams fitting within and being movable along the respective elongated entry portions of the guide grooves in the facing sides of the side walls of the foot element when the strut is being mounted on or removed from said foot element, and when located in the terminal portions of the grooves, are rotatable therein to enable said strut element to be oriented in a use position yet prevent unintentional separation from said foot element.

* * * * *